US008212423B2

(12) United States Patent
Saito

(10) Patent No.: US 8,212,423 B2
(45) Date of Patent: Jul. 3, 2012

(54) SWITCHING CONTROLGEAR OF CIRCUIT BREAKER

(75) Inventor: Minoru Saito, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 376 days.

(21) Appl. No.: 12/442,777

(22) PCT Filed: Sep. 25, 2007

(86) PCT No.: PCT/JP2007/001039

§ 371 (c)(1),
(2), (4) Date: Mar. 11, 2010

(87) PCT Pub. No.: WO2008/041352

PCT Pub. Date: Apr. 10, 2008

(65) Prior Publication Data

US 2010/0200383 A1 Aug. 12, 2010

(30) Foreign Application Priority Data

Sep. 25, 2006 (JP) ..... 2006-258886

(51) Int. Cl.
*H01H 50/86* (2006.01)
*H01H 50/90* (2006.01)

(52) U.S. Cl. ..... 307/127

(58) Field of Classification Search ..... 307/127
See application file for complete search history.

(56) References Cited

U.S. PATENT DOCUMENTS 5,361,184 A * 11/1994 El-Sharkawi et al. ..... 361/93.6

(Continued)

FOREIGN PATENT DOCUMENTS

DE 19882678 8/2000

(Continued)

OTHER PUBLICATIONS

"Controlled Switching of HVAC Circuit Breakers Guide for Application Lines, Reactors, Capacitor, Transformers (1st Part)", ELECTRA, No. 183, pp. 43-73, (1999).

(Continued)

*Primary Examiner* — Adi Amrany
(74) *Attorney, Agent, or Firm* — Oblon, Spivak, McClelland, Maier & Neustadt, L.L.P.

(57) ABSTRACT

A switching controlgear of circuit breaker 100 outputs an opening command signal or closing command signal to the circuit breaker with the maximum being 1 cycle or less of wait time when the opening command signal or closing command signal is detected, and can cause the circuit breaker to open or to close at a desired phase of the main circuit current or power system voltage. The switching controlgear of circuit breaker 100 has switching control signal output time calculation means 10 and switching command signal output delay means 20. The switching control signal output time calculation means 10 calculates the switching control signal output time using the detection timing of the opening command signal or closing command signal as a reference so that the circuit breaker opens or closes at the desired phase after the total time of the switching control signal output time and the estimated opening operation time or estimated closing operation time of the circuit breaker 620 is elapsed. The switching command signal output delay means 20 outputs a delay-controlled opening command signal or a delay-controlled closing command signal to the circuit breaker after the switching control signal output time, which is the latest, is elapsed when an opening command signal or closing command signal is actually detected.

6 Claims, 11 Drawing Sheets

U.S. PATENT DOCUMENTS

| | | | | |
|---|---|---|---|---|
| 5,638,296 | A * | 6/1997 | Johnson et al. | 700/286 |
| 5,644,463 | A * | 7/1997 | El-Sharkawi et al. | 361/94 |
| 6,172,863 | B1 | 1/2001 | Ito et al. | |
| 6,392,390 | B1 * | 5/2002 | Ito et al. | 323/209 |
| 6,433,980 | B1 | 8/2002 | Tsutada et al. | |
| 7,902,696 | B2 * | 3/2011 | Tsutada et al. | 307/129 |
| 8,018,097 | B2 * | 9/2011 | Saito et al. | 307/112 |
| 8,084,891 | B2 * | 12/2011 | Poeltl et al. | 307/125 |
| 2010/0110600 | A1 * | 5/2010 | Saito et al. | 361/98 |
| 2010/0141050 | A1 * | 6/2010 | Saito et al. | 307/141 |
| 2010/0254060 | A1 * | 10/2010 | Saito et al. | 361/115 |
| 2012/0050937 | A1 * | 3/2012 | Saito et al. | 361/187 |

FOREIGN PATENT DOCUMENTS

| | | |
|---|---|---|
| JP | 03 156820 | 7/1991 |
| JP | 06 020564 | 1/1994 |
| JP | 2000 188044 | 7/2000 |
| JP | 2001 135205 | 5/2001 |

OTHER PUBLICATIONS

Extended European Search Report, issued Apr. 23, 2012, European Patent Appln. No. 07827818.1, pp. 1-6.

* cited by examiner

SWITCHING CONTROLGEAR OF CIRCUIT BREAKER

TECHNICAL FIELD

The present invention relates to a switching controlgear of circuit breaker, and more particularly to a switching controlgear of circuit breaker which causes the circuit breaker to open or to close at a desired phase by delaying an output timing of an opening command signal or closing command signal to the circuit breaker.

BACKGROUND ART

A method for suppressing the generation of transient phenomena, which impacts electric power systems and electric power equipment, by controlling the opening or closing timing of a circuit breaker for power, has been proposed (e.g. see Non-patent Document 1).

A specific invention to implement this method for suppressing the generation of transient phenomena, which has already been proposed, is a switching controlgear of circuit breaker which switches circuit breaker contacts at a timing between a current zero point and a peak value of the interrupting current when the current is interrupted, and controls the closing timing of the circuit breaker contacts according to the type of load when the circuit breaker contacts is closed (e.g. see Patent Document 1).

Another invention which has already been proposed focuses on the fact that a high frequency reignition surge is not generated at a current phase 0° point of the final break point of the circuit breaker when a shunt reactor connected to a bus line is parallel-off controlled in order to compensate for a charge current or adjust voltage of the electric power system, a single phase voltage is input to a circuit breaker opening control device using an voltage transformer, then each current phase is calculated by the circuit breaker opening control device based on the phase of the single phase voltage, and an opening instruction is output to the circuit breaker so that each phase current which flows through the shunt reactor can be interrupted at zero point (e.g. see Patent Document 2).

Both switching controlgear of circuit breakers according to Patent Documents 1 and 2 have a function to delay the output timing of an opening command signal or a closing command signal to the circuit breaker, so as to cause the circuit breaker to open or to close at a predetermined phase when the opening command signal or closing command signal is detected. Such a switching control for a circuit breaker is called "synchronous opening control" or "synchronous closing control".

Patent Document 1: Japanese Patent Application Laid-Open No. H03-156820

Patent Document 2: Japanese Patent Application Laid-Open No. H06-20564

Non-patent Document 1: "Controlled switching of HVAC circuit breakers: Guide for application lines, reactors, capacitors, transformers. SC13", ELECTRA No. 183, p. 43, (1999)

All the above-mentioned switching controlgear of circuit breakers detect a zero cross point of power system voltage or main circuit current after an opening command signal or closing command signal is input to the switching controlgear, and control the output delay timing of the opening command signal or closing command signal to the circuit breaker based on this zero cross point.

A timing chart of a conventional synchronous opening control, shown in Non-patent Document 1, will be described with reference to FIG. 12. In FIG. 12, $t_{separate}$ indicates an opening timing of the circuit breaker contacts, that is, a desired opening phase of main circuit current which opens the circuit breaker contacts.

$T_{target}$ is an opening timing of $t_{separate}$ converted into time, using the zero cross point (timing at current phase)0° of a main circuit current waveform as a reference. In an actual circuit breaker, an arc time $T_{arcing}$, when an arc current flows, exists, so interruption completes electrically when $T_{arcing}$ time elapsed from the timing of $t_{separate}$, which is the current zero point.

For both control devices of Patent Documents 1 and 2 as well, the synchronous opening delay time $T_{delay}$ is calculated so that the circuit breaker contacts open at the timing of $t_{separate}$, when the time of the total of synchronous opening delay time $T_{delay}$ and opening operation time $T_{operating}$ elapses, using the zero cross point of the main circuit current waveform as a reference, just like the timing chart shown in FIG. 12.

In a case of a conventional switching controlgear, if the opening command signal is input to the control device at a timing of $t_{command}$ in FIG. 12, [the switching controlgear] must wait until the next zero cross point of the main circuit current waveform is detected. In FIG. 12, this wait time is indicated by a zero cross point wait time $T_W$. After a further wait for the synchronous opening delay time $T_{delay}$ from the detected next zero cross point, the control device outputs the opening command signal to the circuit breaker at a timing of $t_{control}$.

In other words, the total wait time to be generated from the input of the opening command signal to the control device to the output of the opening command signal to the circuit breaker is "$T_{total}=T_W+T_{delay}$". This length of the total wait time $T_{total}$ depends on the input timing of the opening command signal and the target opening phase, and could reach 2 cycles at most. Also depending on the operation performance of the control device, N cycles (N=1, 2, . . . ) of wait time may be additionally generated.

The synchronous closing control is also represented by a similar timing chart, where a similar total wait time is generated. In the case of the synchronous closing control, however, control is normally performed using the zero cross point of the power system voltage as a reference, and control is also performed considering the pre-arc time of the circuit breaker.

In this way, in the case of the conventional switching controlgear of circuit breaker, a maximum of 2 cycles of idle time is generated to perform synchronous opening control or synchronous closing control. Also depending on the computing performance of the switching controlgear, N cycles (N=1, 2, . . . ) of additional idle time is generated.

SUMMARY OF THE INVENTION

With the foregoing in view, it is an object of the present invention to provide a switching controlgear of circuit breaker which outputs an opening command signal or closing command signal to the circuit breaker with the maximum being 1 cycle or less of wait time when the opening command signal or closing command signal is detected, and can cause the circuit breaker to open or to close at a desired phase of the main circuit current or power system voltage.

To achieve the above object, the present invention provides a switching controlgear of circuit breaker which causes a circuit breaker to open or to close at a desired phase of power system voltage or main circuit current, which has the following technical features.

The switching controlgear of circuit breaker according to the present invention, comprises:

estimated circuit breaker operation time calculation means for constantly and repeatedly calculating an estimated opening operation time or estimated closing operation time of the circuit breaker according to a state of the circuit breaker; switching command signal output delay means for delaying an output timing of an opening command signal or closing command signal to the circuit breaker so as to cause the circuit breaker to open or to close at the desired phase when the opening command signal or closing command signal is detected; switching control signal output time calculation means for calculating a switching control signal output time, which is a delay time from a timing of detecting the opening command signal or closing command signal to a timing of that the switching command signal output delay means outputs the opening command signal or closing command signal to the circuit breaker; reference point detection means for periodically detecting a reference point of the power system voltage or main circuit current; synchronization delay time calculation means for calculating synchronization delay time using the reference point detected by the reference point detection means as a reference; and reference point-command signal interval time calculation means for calculating a reference point-command signal interval time which is time from the reference point to a detection timing of the opening command signal or closing command signal, wherein: the synchronization delay time calculation means calculates the synchronization delay time using the reference point as a reference so that the circuit breaker opens or closes at the desired phase after the total time of the synchronization delay time and estimated opening operation time or the estimated closing operation time of the circuit breaker calculated by the estimated circuit breaker operation time calculation means is elapsed, the switching control signal output time calculation means calculates the switching control signal output time based on the time length relationship of the reference point-command signal interval time and the synchronization delay time calculated by the synchronization delay time calculation means, and the switching command signal output delay means outputs a delay-controlled opening command signal or a delay-controlled closing command signal to the circuit breaker after the switching control signal output time, which is the latest, is elapsed when an opening command signal or closing command signal is actually detected.

The present invention can provide a switching controlgear of circuit breaker which outputs an opening command signal or closing command signal to the circuit breaker with the maximum being 1 cycle or less of wait time when the opening command signal or closing command signal is detected, and can cause the circuit breaker to open at a desired phase of the main circuit current or to close at a desired phase of the power system voltage.

EXPLANATION OF REFERENCE NUMERALS

Figure 1:
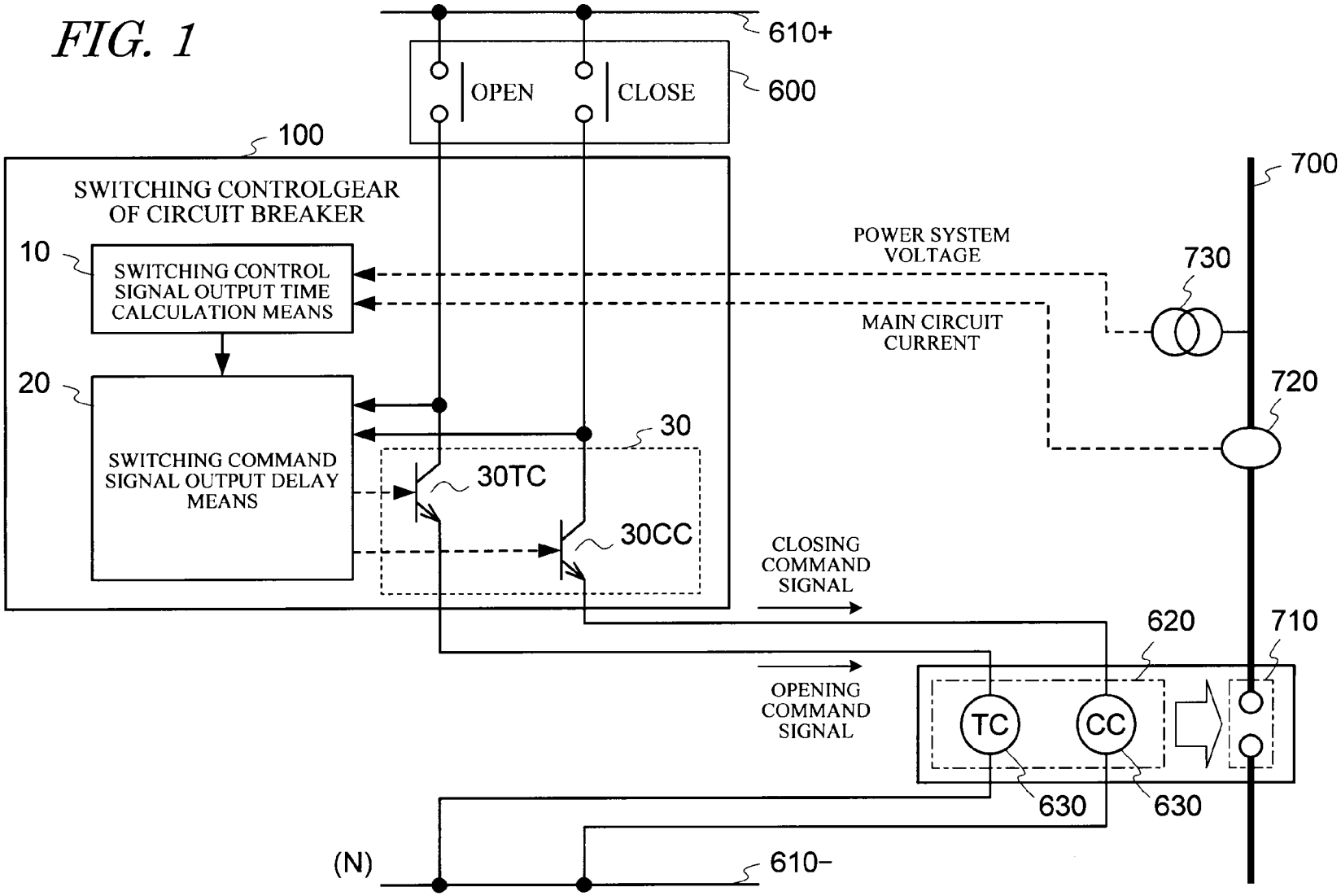
FIG. 1 is a diagram depicting a configuration of a synchronous switching control system of a circuit breaker according to Embodiment 1 of the present invention.

4: MPU (MicroProcessor Unit)
10, 10*a*: switching control signal output time calculation means
11: phase sequence collation means
12: switching control signal output time recalculation processing
20, 20*a*: switching command signal output delay means
30: switching command output unit
40: estimated circuit breaker operation time calculation means
50: synchronization delay time calculation means
60: reference point detection means
70: reference point-command signal interval time calculation means
80: hardware delay time counter
100, 100A to 100D: switching controlgear of circuit breaker
$T_{ssp}$: cycle of calculation task
$T_{control}$: switching control signal output time
$T_{delay}$: synchronous opening delay time
$T_{zero}$: reference point-command signal interval time
$T_{target}$: time from zero cross point to target opening phase ($T_{target}<T_{freq}$)
$T_{command}$ time from zero cross point to reference timing of $T_{control}$ ($T_{command}<T_{freq}$)
$T_{opening}$: opening operation time
$T_{freq}$ system cycle
$T_{arcing}$ arcing time
$t_{command}$: input timing of opening command signal
$t_{control}$: output timing of opening command signal (output timing of synchronous opening control signal)
$t_{separate}$: opening timing of contacts

BEST MODE FOR CARRYING OUT THE INVENTION

Embodiments of the switching controlgear of circuit breaker according to the present invention will now be described with reference to the drawings. A composing element common to the drawings is denoted with a same reference symbol, and a related element is indicated by a suffix subscript, for which redundant description may be omitted.

Embodiment 1

Configuration

FIG. 1 is a diagram depicting a configuration of a synchronous switching control system for a circuit breaker according to Embodiment 1.

In FIG. 1, a main circuit breaker and control circuit thereof are shown only for one phase in order to prevent the drawing from becoming complicated, but needless to say, [the present embodiment] can be applied to a three phase circuit.

In FIG. 1, 700 is a main circuit of a electric power system, 710 is a circuit breaker installed in the main circuit 700, 720 is a current transformer (CT) which transforms and outputs main circuit current, and 730 is an voltage transformer (VT or PD) which transforms and outputs power system voltage.

Various electric power equipment constituting a substation, such as a disconnect switch and earth switch, and various instruments, are connected to the main circuit 700, in addition to the above described system composing apparatuses, but these apparatuses and instruments are omitted here, since they are not directly related to the present invention.

610 is a control power supply circuit. A higher-ranking device 600, such as a protective relay device and BCU (Bay Control Unit), a switching controlgear of circuit breaker 100, which is a major portion of the present invention, and an operation mechanism unit 620 of the circuit breaker 710 are connected in series between a plus side electrode (P) and a ground side electrode (N) of this control power supply circuit 610. The operation mechanism unit 620 is comprised of a circuit breaker driving coil (trip coil TC and closing coil CC) 630.

The switching controlgear of circuit breaker 100 shown in FIG. 1 shows a concept thereof, and has switching control signal output time calculation means 10, switching command signal output delay means 20, and a switching command output unit 30 comprised of such a semiconductor switch as FET and IGBT. The switching command output unit 30 is comprised of an trip switch 30 TC and closing switch 30 CC, so that the semiconductor switch turns ON by a trigger signal which is output from the switching command signal output delay means 20. When the switching command output unit turns ON, a synchronous switching control signal (circuit breaker drive current) of the circuit breaker flows into the circuit breaker drive coil (CC/TC) 630, so as to open or close the contacts of the circuit breaker 710.

A main circuit current signal and power system voltage signal which are output from the current transformer 720 and voltage transformer 730 are input to the switching controlgear of circuit breaker 100, but needless to say, a general use apparatus, not a dedicated apparatus as the current transformer 720 and voltage transformer 730, can be used if the apparatus can detect the main circuit current or power system voltage. If it is sufficient to input only one of main circuit current and power system voltage, depending on the control condition of the circuit breaker, the other can be omitted.

Figure 2:
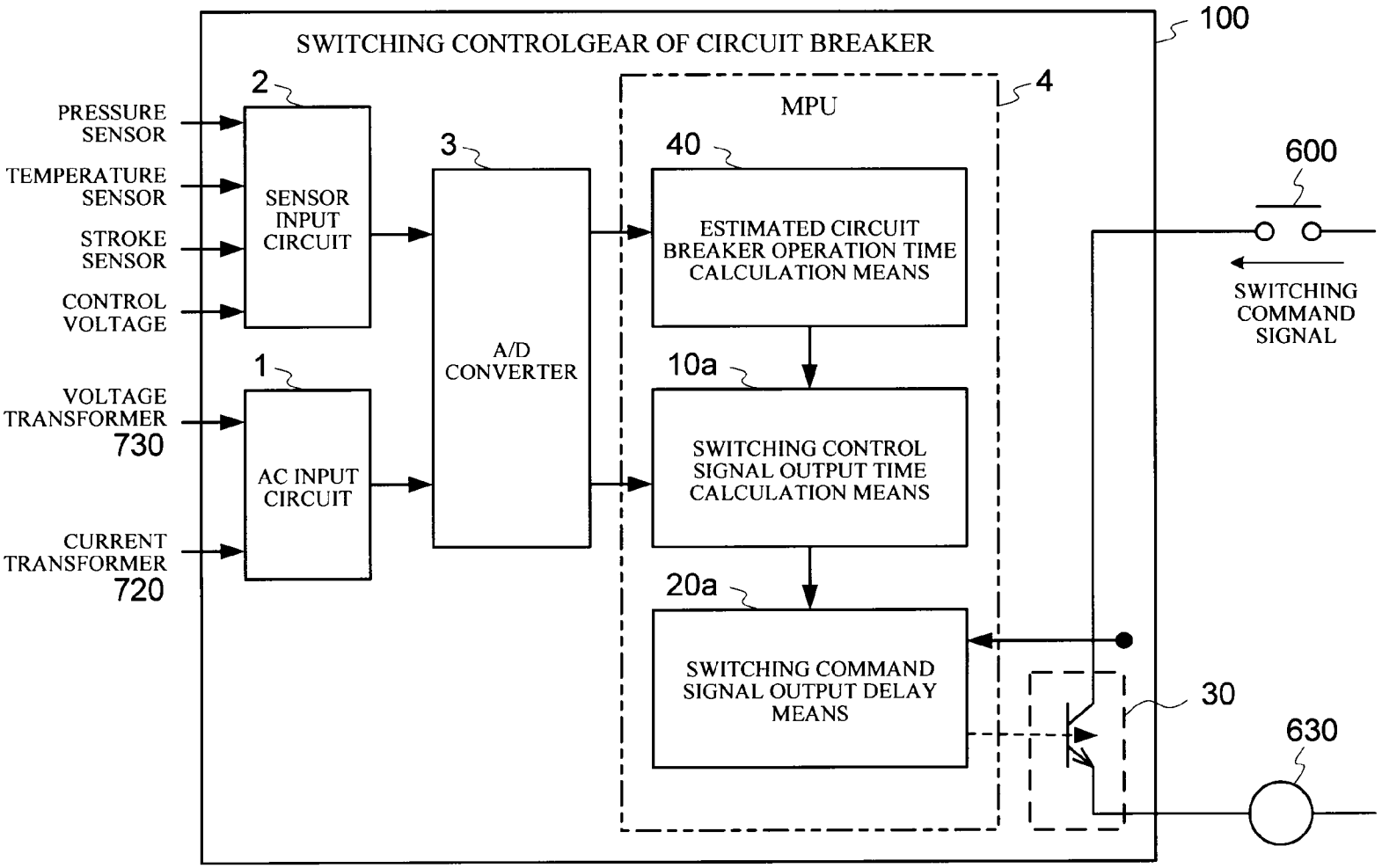
FIG. 2 is a block diagram depicting a detailed configuration of a switching controlgear of circuit breaker according to Embodiment 1 of the present invention.

FIG. 2 is a block diagram depicting a detailed configuration of the switching controlgear of circuit breaker 100 according to Embodiment 1.

In FIG. 2, the switching controlgear of circuit breaker 100 is comprised of an AC input circuit 1, sensor input circuit 2, analog-digital converter (A/D converter in FIG. 2) 3, MPU (Microprocessor Unit) 4, and switching command output unit 30. The switching signal from an external higher-ranking device 600 is input to the MPU 4 and switching command output unit 30, and the circuit breaker drive coil 630 of the circuit breaker operation mechanism unit 620 is driven by an opening command or closing command, which is output from the switching command output unit 30.

The AC input circuit 1 further has an auxiliary CT and PT for electrically insulating the secondary circuits of the current transformer 720 and the voltage transformer 730 and the switching controlgear of circuit breaker 100, and for converting the main circuit current signal and power system voltage signal which was input into an appropriate level, and an analog filter (normally low pass filter) for removing harmonic components out of the outputs of the auxiliary CT and PT, although these composing elements are not illustrated in the above-mentioned AC input circuit 1.

On the other hand, control voltage of the circuit breaker is input to the sensor input circuit 2, and also such signals as pressure signal, temperature signal and stroke signal, which are output from various unillustrated sensors such as the operation pressure sensor, temperature sensor and stroke sensor installed in the circuit breaker operation mechanism unit or the like, are input. The signals which are output from these sensors are normally 4 to 20 mA level DC signals. The sensor input circuit 2 as well also has an insulation circuit and analog filter (normally a low pass filter), just like the AC input circuit 1.

The analog-digital converter 3 samples the outputs of the AC input circuit 1 and sensor input circuit 2, that is such analog signals as the main circuit current signal, power system voltage signal and sensor signal, at a predetermined cycle, and these sample values are converted into digital signals. The main circuit current signal, power system voltage signal and sensor signal converted into digital signals by the analog-digital converter 3 are input to the MPU 4.

The analog-digital converter 3 may be installed for each analog input signal, or may be combined with a multiplexer so that sample values converted into a time series may be converted by one analog-digital converter, or an analog-digital converter integrated for each phase may be used, but the circuit configuration [of the analog-digital converter 3] is not limited.

The MPU 4 executes the estimated circuit breaker operation time calculation processing, switching control signal output time calculation processing and switching command signal output delay processing for input signals converted into digital signals, such as the main circuit current signal, power system voltage signal, sensor signal and switching command signal, using the software processing of a preinstalled program. In other words, the estimated circuit breaker operation time calculation means 40, switching control signal output time calculation means 10*a* and switching command signal output delay means 20*a* are implemented by the combination of the MPU 4 and software processing, and the respective processing of these means 40, 10*a* and 20*a* are executed. In FIG. 1, only the switching control signal output time calculation means 10 and switching command signal output delay means 20 are shown, out of the means implemented by the combination of the MPU 4 and software processing.

Needless to say, the switching control signal output time calculation means 10 and switching command signal output delay means 20 may be implemented by hardware only, or by a combination of hardware and software.

The MPU 4 may integrate the operation functions of three phases into one as the switching controlgear of circuit breaker 100, or an MPU 4 having an identical computing function may be installed for each phase.

(Function)

The function (operation) of the switching controlgear of circuit breaker 100 will be described with reference to FIG. 3.

Figure 3:
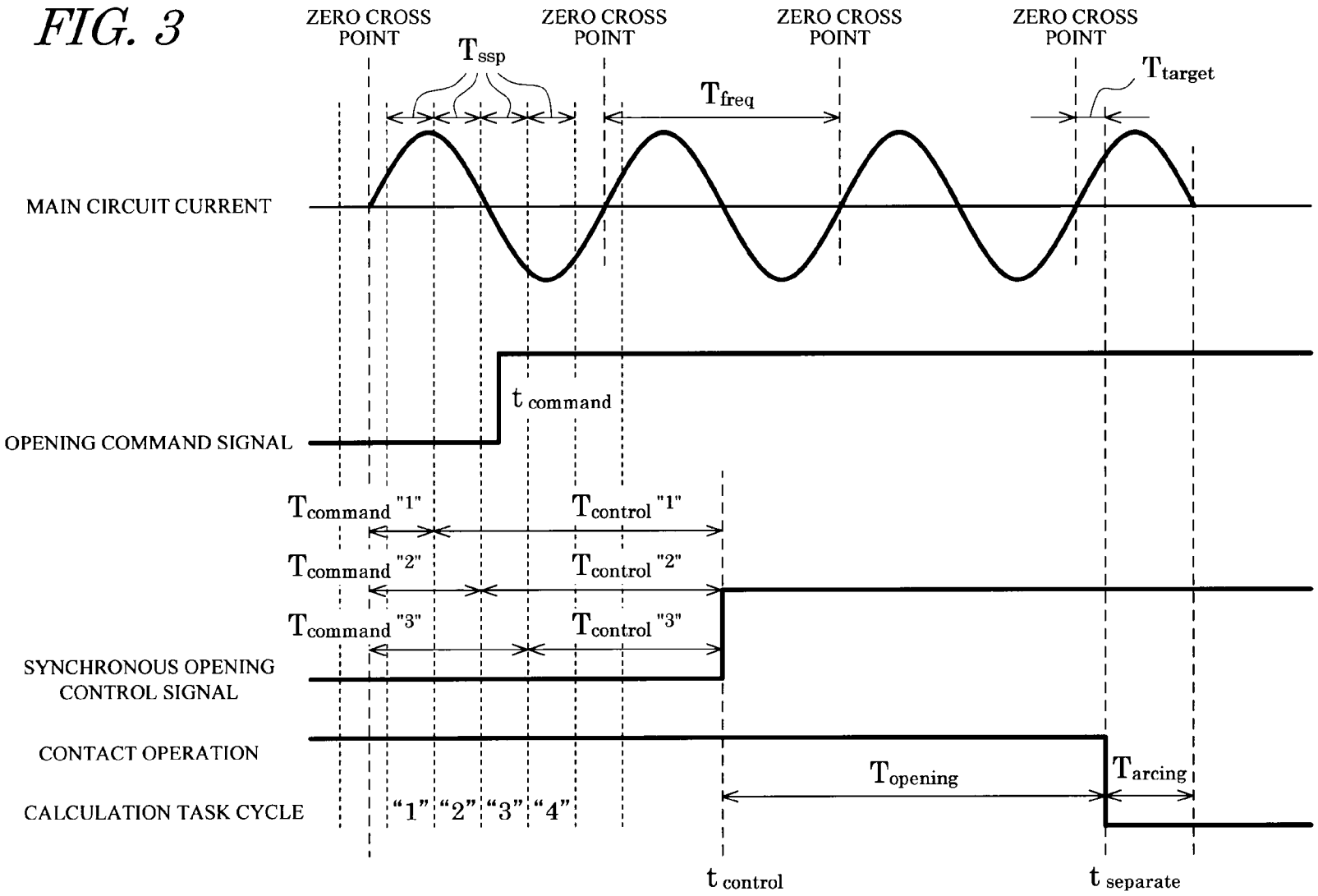
FIG. 3 is a timing chart depicting synchronous opening control of the switching controlgear of circuit breaker according to Embodiment 1 of the present invention.

FIG. 3 is a timing chart depicting the synchronous opening control of the switching controlgear of circuit breaker 100.

The MPU 4 constantly executes the estimated circuit breaker operation time calculation processing by the estimated circuit breaker operation time calculation means 40, the switching control signal output time calculation processing by the switching control signal output time calculation means 10*a*, and the switching command signal output delay processing by the switching command signal output delay means 20*a* repeatedly at a predetermined cycle $T_{ssp}$ (at least at a several ms cycle).

The estimated circuit breaker operation time calculation means 40 estimates the opening operation time $T_{opening}$ of the circuit breaker (contacts) as the estimated circuit breaker operation time calculation processing. The opening operation time $T_{opening}$ of the circuit breaker (contacts) constantly changes depending on the operation pressure of the circuit breaker operation mechanism, ambient temperature, circuit breaker control voltage, circuit breaker operation count, and circuit breaker idle time, for example. The estimated circuit breaker operation time calculation means 40 calculates the corrected value of the opening operation time of the circuit breaker based on this data, which is input from the sensor input circuit via the analog-digital converter 3, and constantly estimates the opening operation time $T_{opening}$ according to the operation environment thereof repeatedly at a predetermined cycle $T_{ssp}$.

The opening operation time $T_{opening}$ is determined by performing:

(1) correction according to the environment conditions (temperature condition, control voltage condition and hydraulic operation pressure condition), and (2) correction according to the circuit breaker idle time, on the actual measurement value $T_{opening}$ 0 under the rated condition. For example, the expression in Non-patent Document 1 is used.

Specifically, the opening operation time $T_{opening}$ of the circuit breaker contacts is given by $$T_{opening}=T_{opening}0+\Delta tP(T1)+\Delta tV(V1)+\Delta tP(P1)+\Delta tH(H1)$$

where ΔtP (T1), ΔtV (V1), ΔtP (P1) and ΔtH (H1) are correction times when the operation hydraulic value of the circuit breaker operation mechanism to be input is P1, ambient temperature is T1, control circuit breaker voltage is V1, and circuit breaker idle time is H1.

"Estimated value calculation" refers to calculating the opening operation time which is corrected based on the rated conditions.

The switching control signal output time calculation means 10*a* repeatedly calculates the switching control signal output time $T_{control}$ repeatedly at a predetermined cycle $T_{ssp}$, as the switching control signal output time calculation processing.

The switching control signal output time calculation means 10*a* calculates the switching control signal output time $T_{control}$ "1" based on the next calculation task "2", in the calculation task "1" in FIG. 3, for example. The calculation expression is as follows.

(1-i) The target opening phase is converted into time using the zero cross point as a reference. In FIG. 3, the time from the zero cross point to the target opening phase is indicated as $T_{target}$.

$T_{target}$ [ms] is given by the following expression (1).

$$T_{target}=T_{freq}\times(\theta_{target}/360)\ [\text{ms}] \quad (1)$$

where $\theta_{target}$ [deg] is the target opening phase, and $T_{freq}$ [ms] is a cycle of the main circuit current.

(1-ii) The phrase $\theta_{command}$ "1" [deg] of the main circuit current at the reference timing of the switching control signal output time $T_{control}$ "1" is calculated. This calculation is performed using the phase calculation algorithm of the following expression (2), which is already being applied for a digital protective relay, for example, using the digital values of the main circuit current signal.

$$\theta_{command}\text{"1"}=\tan^{-1}(\alpha \sin 30°/(1+\alpha \cos 30°))\ [\text{deg}] \quad (2)$$

(1-iii) $\theta_{command}$ "1" [deg] is converted into time using expression (3), with the zero cross point as a reference. In FIG. 3, this time is indicated as $T_{command}$ "1" [ms].

$$T_{command}\text{"1"}=T_{freq}\times(\theta_{command}\text{"1"}/360)\ [\text{ms}] \quad (3)$$

(i-iv) The opening operation time $T_{opening}$ "1" in the calculation task "1" is acquired from the estimated circuit breaker operation time calculation means 40.

(i-v) The switching control signal output time $T_{control}$ "1" is calculated by the following expression (4) or (5) using the result of (1-i) to (1-iv).

The switching control signal output time $T_{control}$ "1" is calculated based on the main circuit current phase of the reference timing of the switching control signal output time $T_{control}$ "1", assuming that the circuit breaker performs opening operation at a desired phase when the total time of the switching control signal output time $T_{control}$ "1" and the opening operation time $T_{opening}$ "1" is elapsed.

If $T_{command}$ "1"≦$T_{target}$, then $$T_{control}\text{"1"}=(T_{target}-T_{command}\text{"1"})-(T_{opening}\text{"1"}\%\ T_{freq})\ [\text{ms}] \quad (4)$$

and if $T_{command}$ "1">$T_{target}$, then $$T_{control}\text{"1"}=(T_{target}-T_{command}\text{"1"}+T_{freq})-(T_{opening}\text{"1"}\%\ T_{freq})\ [\text{ms}] \quad (5)$$

(A % B) refers to the remainder of (A÷B).

The switching control signal output time calculation means 10*a* constantly executes the calculation of (1-i) to (1-v) repeatedly at a predetermined cycle $T_{ssp}$. In other words, in the next calculation task "2", the switching control signal output time $T_{control}$ "2" is calculated based on the calculation task "3" which comes next. Then in the next calculation task "3", the switching control signal output time $T_{control}$ "3" is calculated based on the calculation task "4" which comes next.

In this way, the switching control signal output time calculation means 10*a* constantly calculates the switching control signal output time $T_{control}$ repeatedly at a predetermined cycle $T_{ssp}$. As expression (1) to expression (5) show, it is clear that the range of the calculated switching control signal output time $T_{control}$ is as in the following expression (6).

$$0\leqq T_{control}<T_{freq} \quad (6)$$

Then the switching command signal output delay means 20*a* constantly monitors the presence of the opening command signal $T_{command}$ repeatedly at a predetermined cycle $T_{ssp}$, as the switching command signal output delay processing. When the opening command signal $T_{command}$ is detected, operation, to delay the output of the opening command signal to the circuit breaker (trip coil TC of the circuit breaker operation mechanism unit 620) by the latest switching control signal output time $T_{control}$, is executed.

The time chart in FIG. 3 is an example when the opening command signal $T_{command}$ can be detected in the calculation task "3". In this case, the switching command signal output delay means 20*a* counts the latest switching control signal output time $T_{control}$, that is the delay time of the switching control signal output time $T_{control}$ "3" based on the next calculation task "4". The switching command signal output delay means 20*a* outputs a trigger signal to the switching command output unit 30 when the delay time of the latest switching control signal output time $T_{control}$ "3" elapses.

By this, the switching command output unit 30, to which the trigger signal was input, turns ON, so the synchronous opening control signal (circuit breaker drive current) of the circuit breaker flows through the circuit breaker drive coil 630 (trip coil TC), and the opening operation of the circuit breaker is executed.

In the above description, an example of the responding operation of the switching controlgear of circuit breaker 100 according to Embodiment 1 was described with reference to the timing chart of the synchronous opening operation, but the switching controlgear of circuit breaker 100 also responds and operates in the same way in the timing chart of the synchronous closing control.

Embodiment 1 was described based on the assumption that the estimated circuit breaker operation time calculation processing by the estimated circuit breaker operation time calculation means 40, the switching control signal output time calculation processing by the switching control signal output time calculation means 10*a*, and the switching command signal output delay processing by the switching command signal output delay means 20*a*, are constantly executed repeatedly at a predetermined cycle $T_{ssp}$, but these processings may be executed asynchronously with each other, or may be executed non-periodically. Also needless to say, the tasks may be subdivided.

The present embodiment is based on the assumption that the MPU 4 can perform multi-task processing, and can execute the estimated circuit breaker operation calculation processing by the estimated circuit breaker operation time calculation means 40, the switching control signal output time calculation processing by the switching control signal output time calculation means 10*a*, and the switching command signal output delay processing by the switching command signal output delay means 20*a*, in parallel, but execution of these processings may be distributed to a plurality of MPUs which perform single task processing. Also needless to say, the execution of these processings may be distributed to a plurality of CPUs which can perform multi-task processing.

(Advantageous Effect)

As described above, according to the switching controlgear of circuit breaker of Embodiment 1, the time difference from the input of the switching command signal to the output of the switching command signal is the switching control signal output time $T_{control}$. The range of the switching control signal output time $T_{control}$ is as follows.

$$0 \leqq T_{control} < T_{freq}$$

Therefore according to Embodiment 1, a switching controlgear of circuit breaker, which outputs an opening command signal or closing command signal to the circuit breaker with a maximum 1 cycle or less of wait time when the opening command signal or closing command signal is detected, and can cause the circuit breaker to open at a desired phase of the main circuit current or to close at a desired phase of the power system voltage, can be provided.

Embodiment 2

Now a switching controlgear of circuit breaker according to Embodiment 2 of the present invention will be described.

(Configuration)

The configuration of the synchronous switching control system of the circuit breaker according to Embodiment 2 of the present invention, which is the same as the configuration according to Embodiment 1 in FIG. 1, is omitted, and only the block diagram depicting the detailed configuration of the switching controlgear of circuit breaker 100A is shown.

The detailed configuration of the switching controlgear of circuit breaker 100A according to Embodiment 2 will now be described with reference to FIG. 4.

In the switching controlgear of circuit breaker 100A according to Embodiment 2, reference point detection means 60, synchronization delay time calculation means 50 and reference point-command signal interval time calculation means 70 are added to the switching controlgear of circuit breaker 100 in FIG. 2.

Figure 4:
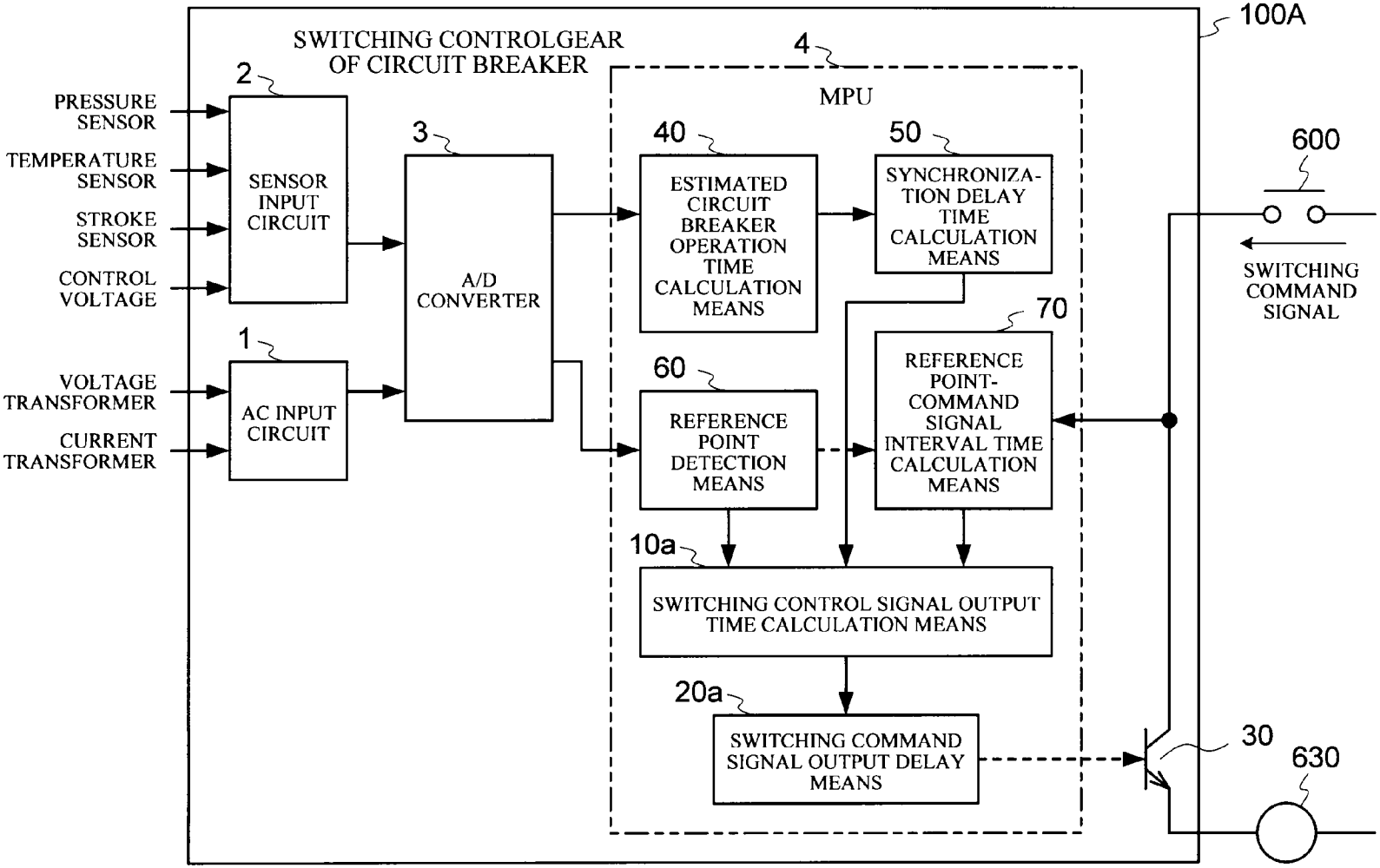
FIG. 4 is a block diagram depicting a detailed configuration of a switching controlgear of circuit breaker according to Embodiment 2 of the present invention.

In other words, in FIG. 4, the switching controlgear of circuit breaker 100A has an AC input circuit 1, sensor input circuit 2, analog-digital converter 3, MPU 4 and switching command output unit 30, just like the configuration of Embodiment 1, but a difference of Embodiment 2 from Embodiment 1 is the processing content of MPU 4, and in addition to the processing content of the MPU 4 of Embodiment 1, a synchronization delay time calculation processing by the synchronization delay time calculation means 50, reference point detection processing by the reference point detection means 60, and reference point-command signal interval time calculation processing by the reference point-command signal interval time calculation means 70, are also executed. These means and processings are implemented and executed by the MPU 4 and in software processing by a program preinstalled in the MPU 4.

(Function)

The function of Embodiment 2 will now be described with reference to the timing chart of the synchronous opening control of the switching controlgear of circuit breaker.

Figure 5:
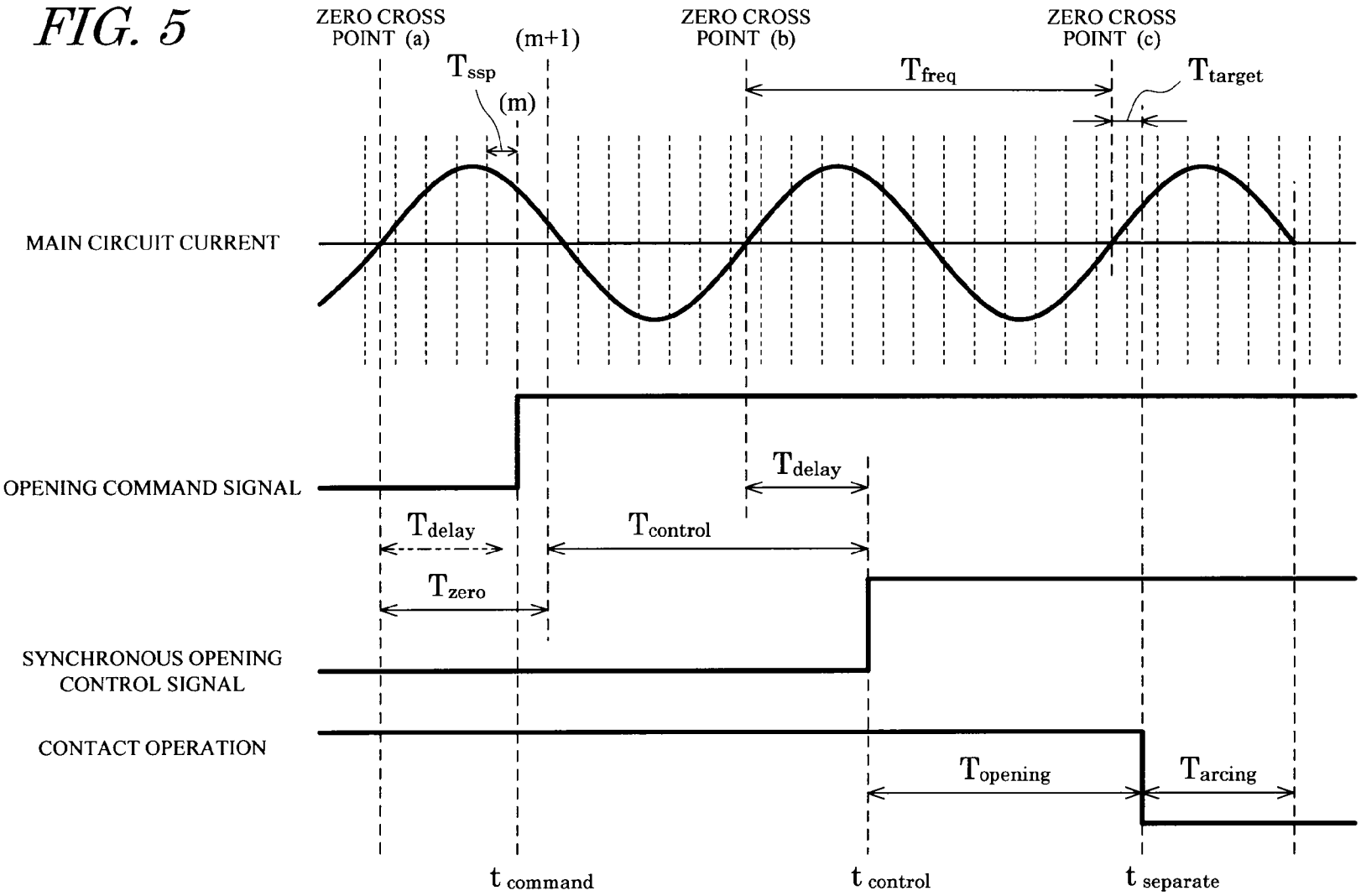
FIG. 5 is a timing chart depicting synchronous opening control of the switching controlgear of circuit breaker according to Embodiment 2 of the present invention.

The MPU 4 operates in two tasks having different cycles, a first task and a second task, as shown in FIG. 5.

The first task is a task which constantly executes processing repeatedly at a predetermined cycle $T_{ssp}$ at high-speed (at least at a several ms cycle), and executes the reference point detection processing by the reference point detection means 60, reference point-command signal time calculation processing by the reference point-command signal time calculation means 70, switching control signal output interval time calculation processing by the switching control signal output interval time calculation means 10*a*, and switching command signal output delay processing by the switching command signal output delay means 20*a*, for example.

The second task is a task which constantly executes a processing repeatedly at a cycle $T_{100ms}$ which is slower than the cycle $T_{ssp}$ (cycle up to several hundred ms is allowed), and executes the estimated circuit breaker operation time calculation processing by the estimated circuit breaker operation time calculation means 40, and synchronization delay time calculation processing by the synchronization delay time calculation means 50, for example.

The first and second tasks will now be described in detail.

<Operation of Second Task: Calculation Task in Cycle $T_{100ms}$>

The estimated circuit breaker operation time calculation means 40 estimates the opening operation time $T_{opening}$ of the circuit breaker as the estimated circuit breaker operation time calculation processing. The opening operation time $T_{opening}$ of the circuit breaker constantly changes depending on the operation pressure of the circuit breaker operation mechanism, ambient temperature, circuit breaker control voltage, circuit breaker operation count and circuit breaker idle time, for example, just like Embodiment 1.

The estimated circuit breaker operation time calculation means 40 calculates the correction value of the opening operation time of the circuit breaker based on this data which is input from the sensor input circuit or the like, and constantly estimates the opening operation time $T_{opening}$ according to the operation environment thereof repeatedly at a predetermined cycle $T_{100ms}$.

The synchronization delay time calculation means 50 constantly calculates the synchronous opening delay time $T_{delay}$ based on the zero cross point of the main circuit current (timing at phase 0° of the main circuit current) repeatedly at a predetermined cycle $T_{100ms}$ as the synchronization delay time calculation processing.

The synchronous opening delay time $T_{delay}$ [ms] is calculated as follows, and this calculation is based on the assumption that the circuit breaker performs opening operation at a desired phase when the total of the synchronous opening delay time $T_{delay}$ and the opening operation time $T_{opening}$ is elapsed from the zero cross point as a reference point.

$$T_{delay}=T_{target}-(T_{opening}\ \%\ T_{freq})\ [\text{ms}] \tag{7}$$

If $T_{delay}<0$, then $T_{delay}$ is corrected to be a positive value by the following expression.

$$T_{delay}=T_{delay}+T_{freq} \tag{8}$$

Here (A % B) refers to a remainder of (A÷B).

The definitions and calculation methods of $T_{target}$, $T_{opening}$ and $T_{freq}$ are the same as Embodiment 1.

<Operation of First Task: Calculation Task in Cycle $T_{ssp}$>

In the reference point detection processing, the reference point detection means 60 constantly detects the timing of the zero cross point (timing when the phase of the main circuit current is)0° repeatedly in a calculation task at a predetermined cycle $T_{ssp}$, as a reference point of the main circuit current.

Figure 6:
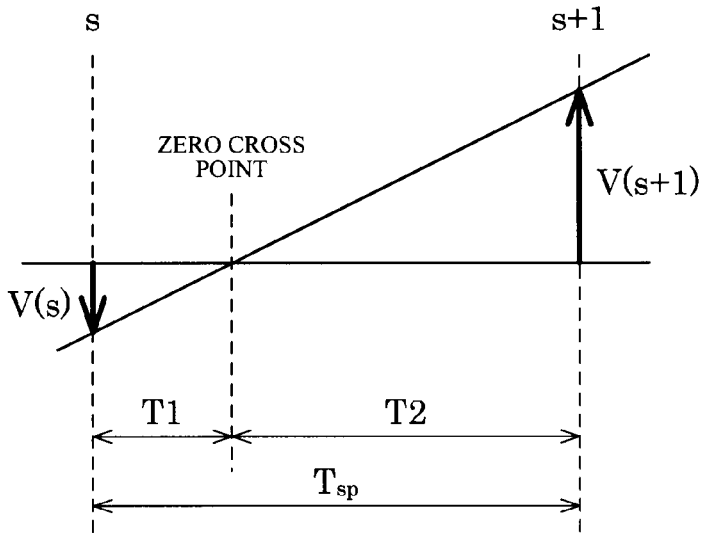
FIG. 6 is a diagram depicting a method for detecting a zero cross point of the main circuit current or power system voltage according to Embodiment 2 of the present invention.

FIG. 6 shows a zero cross point detection method.

The reference point detection means 60 detects sampling data at two points having different signs, that is, the sampling data V (s) immediately before the zero cross point, and the sampling data V (s+1) immediately after the zero cross point, as shown in FIG. 6.

The time difference T1 [ms] between the sampling timing s immediately before the zero cross point and the zero cross point shown in FIG. 6 is calculated using the following expression.

$$T1=|V(s)|/(|V(s)|+|V(s+1)|)\times T_{sp} \tag{9}$$

Here, $T_{sp}$ is a sampling cycle.

Here the time of the actual zero cross point of the main circuit current or power system voltage and the time of the zero cross point which the reference point detection means 60 of the switching controlgear of circuit breaker 100A recognizes are different. This is because the main circuit current or the power system voltage recognized by the reference point detection means 60 delays compared with the actual main circuit current or the power system voltage, since the analog filter (normally a low pass filter), analog-digital converter and peripheral circuits thereof, the digital filter implemented by the processing of the MPU, and other components exist in the input circuit of the main circuit current signal or the power system voltage signal of the switching controlgear of circuit breaker 100A.

Figure 7:
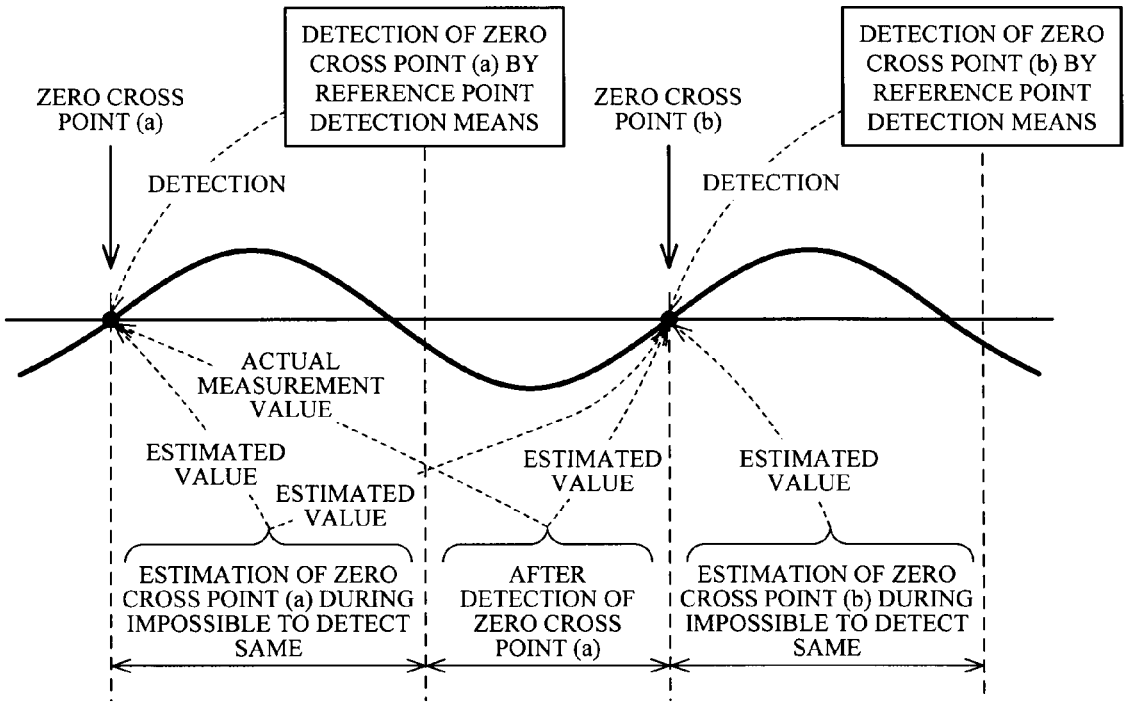
FIG. 7 is a diagram depicting a method for estimating a zero cross point of the main circuit current or power system voltage according to Embodiment 2 of the present invention.

Therefore, even if the actual main circuit current or the power system voltage passes the zero cross point, it takes time until the reference point detection means 60 recognizes this, and a required control during this period cannot be performed. In this case, this control is performed after the next zero cross point. By repeating this state, it becomes necessary to take time to recognize whether [the actual main circuit current or power system voltage] passes the zero cross point or not, and a timing when control cannot be performed is generated. To prevent this, Embodiment 2 has a means for estimating the next zero cross point or actual latest zero cross point using the actual measurement value of the latest zero cross point, as shown in FIG. 7.

The reference point-command signal interval time calculation means 70 constantly monitors the presence of the opening command signal repeatedly at a predetermined cycle $T_{ssp}$, as the reference point-command signal time calculation processing. When the opening command signal is detected, the reference point-command signal interval time $T_{zero}$, which is a time from the zero cross point to the detection of the opening command signal, is calculated. Specifically, if the opening command signal is detected in the calculation task (m) in the cycle $T_{ssp}$ in FIG. 5, the time from the zero cross point to the timing of the next calculation task (m+1) is calculated as the reference point-command signal interval time $T_{zero}$.

The switching control signal output time calculation means 10*a* calculates the switching control signal output time $T_{control}$ using the synchronous opening delay time $T_{delay}$ calculated by the synchronization delay time calculation means 50 and the reference point-command signal interval time $T_{zero}$ calculated by the reference point-command signal interval time calculation means 70.

Now the processing to calculate the switching control signal output time $T_{control}$ when the opening command signal is input to the switching controlgear of circuit breaker 100A at the timing $t_{command}$ will be described with reference to FIG. 5.

(2-i) Whether control is possible is judged based on the zero cross point (a) in FIG. 5.

If the reference point-command signal interval time $T_{zero}\leqq$synchronous opening delay time $T_{delay}$, then control based on the zero cross point (a) is possible, so the switching control signal output time $T_{control}$ based on the timing of the next calculation task (m+1) can be calculated by the following expression.

$$T_{control}=T_{delay}-T_{zero} \tag{10}$$

In the case of the example in FIG. 5, however, the reference point-command signal interval time $T_{zero}>$synchronous opening delay time $T_{delay}$, so the switching control signal output time $T_{control}$ cannot be calculated using the expression in (2-i). Therefore the calculation in (2-ii) is performed next.

(2-ii) Since the control based on the zero cross point (a) in FIG. 5 is impossible, control based on the next zero cross point (b) is performed. The switching control signal output time $T_{control}$ based on the timing of the next calculation task (m+1) can be calculated by the following expression.

$$T_{control}=T_{delay}+(T_{freq}-T_{zero}) \tag{11}$$

The range of the switching control signal output time $T_{control}$ calculated in this way is the same as the above-mentioned expression (6).

$$0\leqq T_{control}<T_{freq} \qquad \text{(6) mentioned above}$$

The switching command signal output delay means 20*a* executes the operation to delay the output of the opening command signal to the circuit breaker (trip coil TC of the circuit breaker operation mechanism unit) by the switching control signal output time $T_{control}$ calculated by the switching control signal output time calculation means 10*a*.

In the case of the example in FIG. 5, the switching command signal output delay means 20*a* counts the delay time of the switching control signal output time $T_{control}$ calculated by the switching control signal output time calculation means 10*a* with the timing of the calculation task (m+1) as the start point. After the delay time of the switching control signal output time $T_{control}$ elapses, the switching command signal output delay means 20*a* outputs the trigger signal to the switching command output unit 30.

When the trigger signal is input, the switching command output unit 30 turns ON, the synchronous opening control signal of the circuit breaker (circuit breaker drive current) flows through the circuit breaker drive coil 630 (trip coil TC), and the circuit breaker performs opening operation.

In the above description according to Embodiment 2, when the opening command signal is detected, the reference point-command signal interval time calculation means 70 calculates the reference point command-signal interval time $T_{zero}$, and the switching control signal output time calculation means 10*a* calculates the switching control signal output time $T_{control}$ and the switching command signal output delay means 20*a* outputs the trigger signal to the switching command output unit 30, but the same effect can be implemented even if the processing is changed to operate as follows.

In other words, regardless whether the opening command signal is actually detected or not, the reference point-command signal interval time calculation means 70 constantly calculates the reference point-command signal interval time $T_{zero}$, and the switching control signal output time calculation means 10*a* constantly calculates the switching control signal output time $T_{control}$ repeatedly in the calculation task at a predetermined cycle $T_{ssp}$, assuming that the opening command signal is detected, and when the opening command signal output delay means 20*a* actually detects the opening command signal, the trigger signal is output to the opening command output unit 30 using the pre-calculated switching control signal output time $T_{control}$.

In this case, the same effect can be implemented even if a means other than the opening command signal output delay means 20*a* executes the detection of the opening command signal.

In the above description, an example of the operation and function of the switching controlgear of circuit breaker 100A of Embodiment 2 was described using the timing chart of the synchronous opening control, but the switching controlgear of circuit breaker 100 executes a similar operation, and a same function can be implemented in the timing chart of the synchronous closing control as well.

Embodiment 2 was described above based on the assumption that the estimated circuit breaker operation time calculation processing by the estimated circuit breaker operation time calculation means 40, switching control signal output time calculation processing by the switching control signal output time calculation means 10*a*, and switching command signal output delay processing by the switching command signal output delay means 20*a*, are constantly executed repeatedly at predetermined cycles $T_{ssp}$ and $T_{100ms}$, but these processing may be executed asynchronously with each other, or may be executed non-periodically. Also needless to say, the tasks may be sub-divided.

Embodiment 2 is also based on the assumption that the MPU 4 can perform multi-task processing, and can execute the estimated circuit breaker operation calculation processing by the estimated circuit breaker operation time calculation means 40, switching control signal output time calculation processing by the switching control signal output time calculation means 10*a*, and the switching command signal output delay processing by the switching command signal output delay means 20*a* in parallel, but execution of these processings may be distributed into a plurality of MPUs which perform single task processing. Also needless to say, the execution of these processings may be distributed into a plurality of CPUs which can perform multi-task processing.

(Advantageous Effect)

As described above, according to Embodiment 2, just like Embodiment 1, a switching controlgear of circuit breaker, which outputs an opening command signal or closing command signal to the circuit breaker with a maximum 1 cycle or less of wait time when the opening command signal or closing command signal is detected, and can cause the circuit breaker to open or to close at a desired phase of the main circuit current or the power system voltage, can be provided.

Additionally, operation load on the MPU is smaller in Embodiment 2 than in Embodiment 1, so a less expensive MPU and less expensive peripheral circuits, such as memory, can be used. This is because the processing which is always performed periodically in Embodiment 1 is distributed into sub-divided tasks, and priority is assigned to the execution speed of the tasks in Embodiment 2.

Hence Embodiment 2 can provide a less expensive switching controlgear of circuit breaker than Embodiment 1.

Embodiment 3

A switching controlgear of circuit breaker according to Embodiment 3 of the present invention will now be described.

(Configuration)

The configuration of the synchronous switching control system of the circuit breaker according to Embodiment 3 of the present invention, which is the same as embodiment 1 and Embodiment 2, is omitted, and only the block diagram depicting the detailed configuration of the switching controlgear of circuit breaker 100B is shown.

Figure 8:
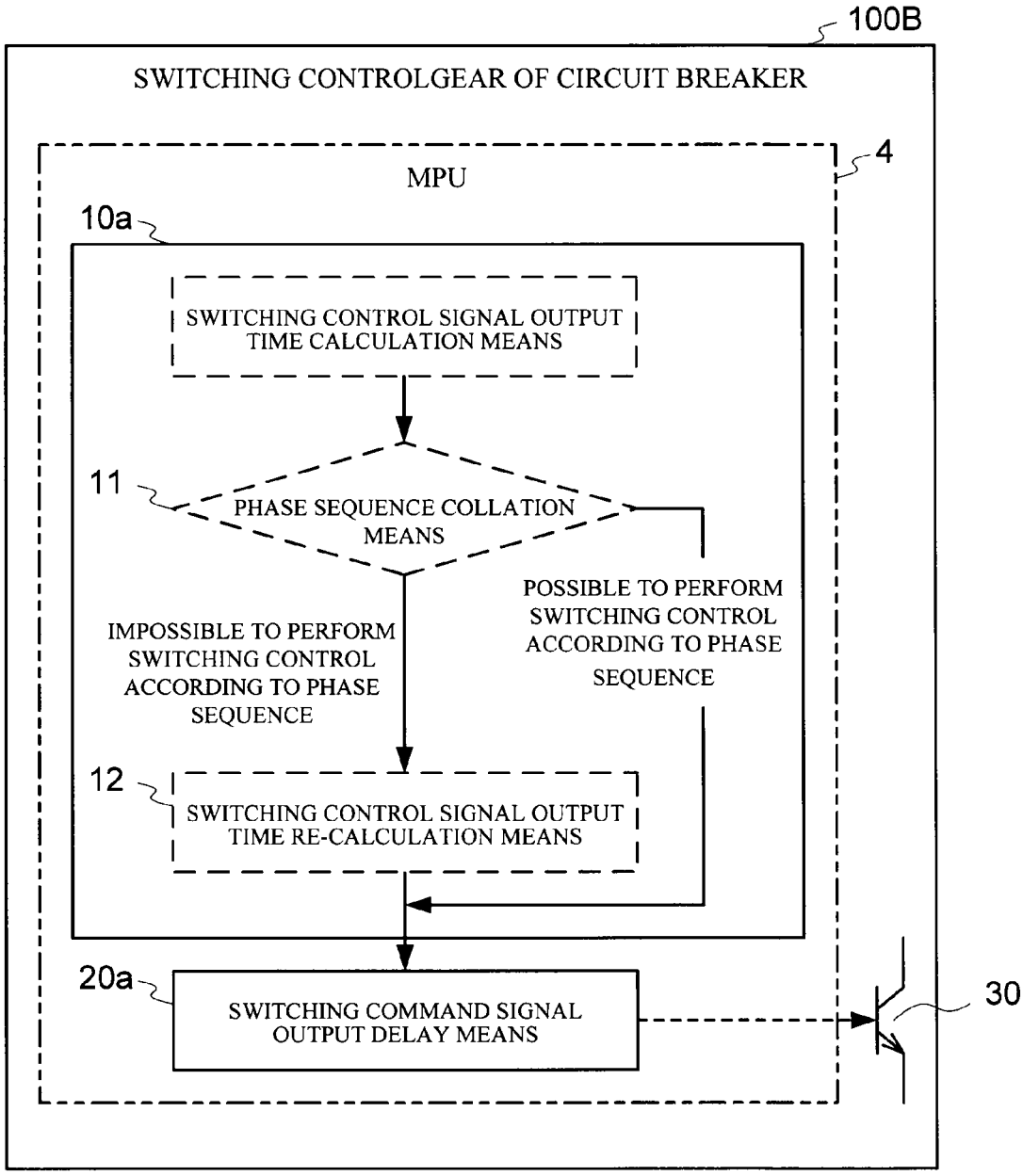
FIG. 8 is a block diagram depicting a detailed configuration of a switching controlgear of circuit breaker according to Embodiment 3 of the present invention.

As FIG. 8 shows, a difference of the switching controlgear of circuit breaker 100B of Embodiment 3 from Embodiment 1 or Embodiment 2 is that a later mentioned phase sequence collation means 11 and switching control signal output time re-calculation means 12 are integrated into a part of the switching control signal output time calculation means 10*a* of the switching controlgear of circuit breaker 100B.

(3-i) Phase Sequence Collation Processing by Phase Sequence Collation Means 11

When [switching] is controlled using the calculated switching control signal output time $T_{control}$, it is estimated and collated in advance whether opening or closing can be controlled according to the specified first phase and phase sequence.

(3-ii) Switching Control Signal Output Time Re-Calculation Processing by Switching Control Signal Output Time Re-Calculation Means 12

If it is judged that opening or closing cannot be controlled according to the specified first phase and phase sequence in the collation result in (3-i), then the switching control signal output time $T_{control}$ is re-calculated.

The means 11 and 12 for implemented the processing in (3-i) and (3-ii) may be a means independent from the switching control signal output time calculation means 10*a*, or may be integrated into other existing means, such as switching command signal output delay means 20*a*.

(Function)

The function of Embodiment 3 will now be described with reference to the timing chart of the synchronous opening control of the switching controlgear of circuit breaker.

According to Embodiment 3, the time length relationship of the switching control signal output time $T_{control}$ among each phase is adjusted according to the specified first phase and phase sequence when the first phase of opening or closing is specified, or when the phase sequence of opening or closing is specified, or when both the first phase and phase sequence of opening or closing are specified.

For example, a case when the first phase of opening is phase A, second phase of opening is phase B, and third phase of opening is phase C is considered.

It is assumed that the opening command signal is input to the switching controlgear of circuit breaker 100B at a certain timing, and the switching control signal output time calculation means 10*a* calculates the switching control signal output time $T_{control}$ (phase A), $T_{control}$ (phase B) and $T_{control}$ (phase C) of each phase. And it is assumed that when the switching command signal output delay means 20*a* outputs a trigger signal to the switching command output unit 30 directly using the calculated switching control signal output time $T_{control}$ (phase A), $T_{control}$ (phase B) and $T_{control}$ (phase C), the phase sequence collation means 11 estimated that the first phase of opening is phase B, second phase of opening is phase C, and third phase of opening is phase A, and judged that opening cannot be controlled according to the specified phase sequence.

In this case, the following processing is executed so that the opening operation can be executed in a desired opening phase according to the sequence of the first phase of opening as phase A, second phase of opening as phase B, and third phase of opening as phase C.

(3-iii) The switching control signal output time re-calculation means 12 of the switching control signal output time calculation means 10*a* re-calculates the switching control signal output time $T'_{control}$ (phase A), $T'_{control}$ (phase B) and $T'_{control}$ (phase C) by the following expressions, so that the opening operation is executed according to the specified phase sequence.

$$T'_{control}\text{ (phase A)}=T'_{control}\text{ (phase A)}$$

$$T'_{control}\text{ (phase } B)=T'_{control}\text{ (phase } B)+T_{freq}$$

$$T'_{control}\text{ (phase } C)=T'_{control}\text{ (phase } C)+T_{freq}$$

(3-iv) The switching command signal output delay means 20*a* counts the delay time of the re-calculated switching control signal output time $T'_{control}$ (phase A), $T'_{control}$ (phase B) and $T'_{control}$ (Phase C) respectively for each phase. When the delay times of the switching control signal output time $T'_{control}$ (phase A), $T'_{control}$ (phase B) and $T'_{control}$ (phase C) are elapsed, the switching command signal output delay means 20*a* outputs a trigger signal to the switching command output unit 30 respectively for each phase.

As described above, the phase sequence collation means 11 estimates the first phase and phase sequence in which the circuit breaker performs opening operation before the switching command signal output delay means 20*a* outputs the trigger signal to the switching command output unit 30, and if [the estimated first phase and phase sequence] are different from the specified first phase and phase sequence, then the switching control signal output time re-calculation means 12 executes re-calculation processing by adding or subtracting the switching control signal output time $T_{control}$ in 1 cycle units, whereby the opening operation can be performed at a desired opening phase according to the specified first phase and phase sequence.

In the above description, the case of the synchronous opening control of the switching controlgear of circuit breaker 100 B of Embodiment 3 was described, but needless to say, the switching controlgear of circuit breaker 100B operates in the same way in the synchronous closing control.

(Advantageous Effect)

According to Embodiment 3, opening or closing control of the circuit breaker can be executed at a desired phase according to the specified first phase and phase sequence when the first phase of opening or closing is specified, or when the phase sequence of opening or closing is specified, or when both the first phase and phase sequence of opening or closing is specified.

Embodiment 4

Now a synchronous switching controlgear of a circuit breaker according to Embodiment 4 of the present invention will be described.

(Configuration)

Figure 9:
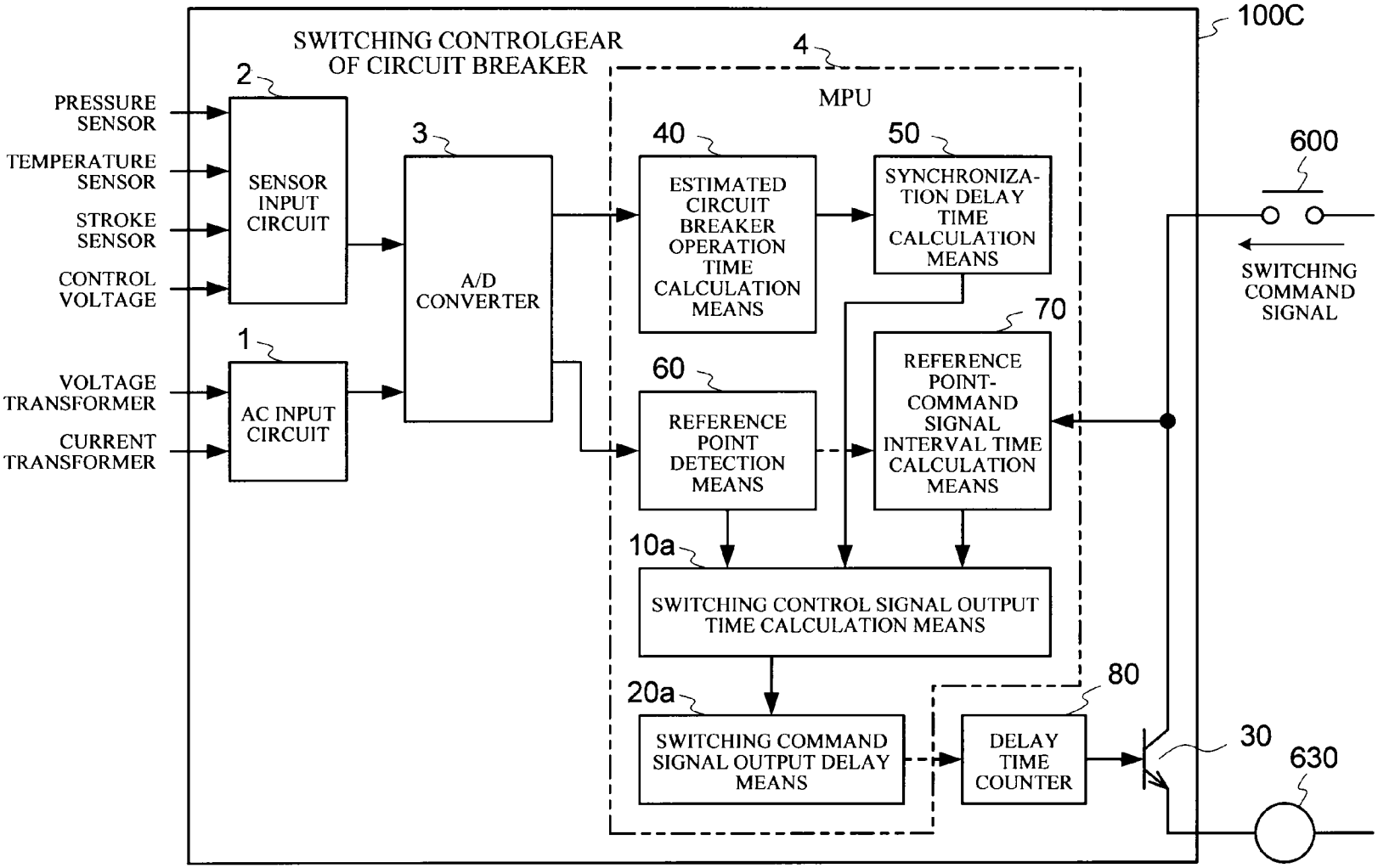
FIG. 9 is a block diagram depicting a detailed configuration of a switching controlgear of circuit breaker according to Embodiment 4 of the present invention.

The configuration of the synchronous switching control system of the circuit breaker according to Embodiment 4, which is the same as Embodiment 1 or Embodiment 2, is omitted, and only a block diagram depicting the detailed configuration of the switching controlgear of circuit breaker 100C in FIG. 9 is shown.

In FIG. 9, just like the configuration of Embodiment 1 or Embodiment 2, the switching controlgear of circuit breaker 100C has an AC input circuit 1, sensor input circuit 2, analog-digital converter 3, MPU (Microprocessor Unit) 4, and switching command output unit 30. A detailed description on this configuration, which is the same as Embodiment 1 or Embodiment 2, is omitted.

A difference of Embodiment 4 from Embodiment 1 or Embodiment 2 is that a delay time counter 80, which is hardware, is newly added as a composing element.

Generally a hardware counter has higher precision than a software counter, and can execute fine countering (high resolution counting). If the maximum count value of a hardware counter is too high, however, the hardware scale of the counter increases accordingly, so it is not preferable to implement all counting applications by hardware only.

Therefore according to Embodiment 4, the count operation of the switching control signal output time $T_{control}$ is implemented by roughly counting by software counter (counting operation by the switching command signal output delay means 20*a*) and fine counting by hardware counter (delay time counter 80).

The switching controlgear of circuit breaker 100C in FIG. 9 turns the switching command output unit 300N when the delay time of the switching control signal output time $T_{control}$, calculated by the switching control signal output time calculation means 10*a* of the MPU 4, is elapsed, and according to Embodiment 4, the count operation of the switching control signal output time $T_{control}$ at this time is implemented by a combination of (i) the count operation of the software counter by the switching command signal output delay means 20*a* of the MPU 4, and (ii) the count operation of the delay time counter 80 which is a hardware counter.

(Function)

The counting method of the switching control signal output time of the switching controlgear of circuit breaker according to Embodiment 4 will now be described.

Figure 10:
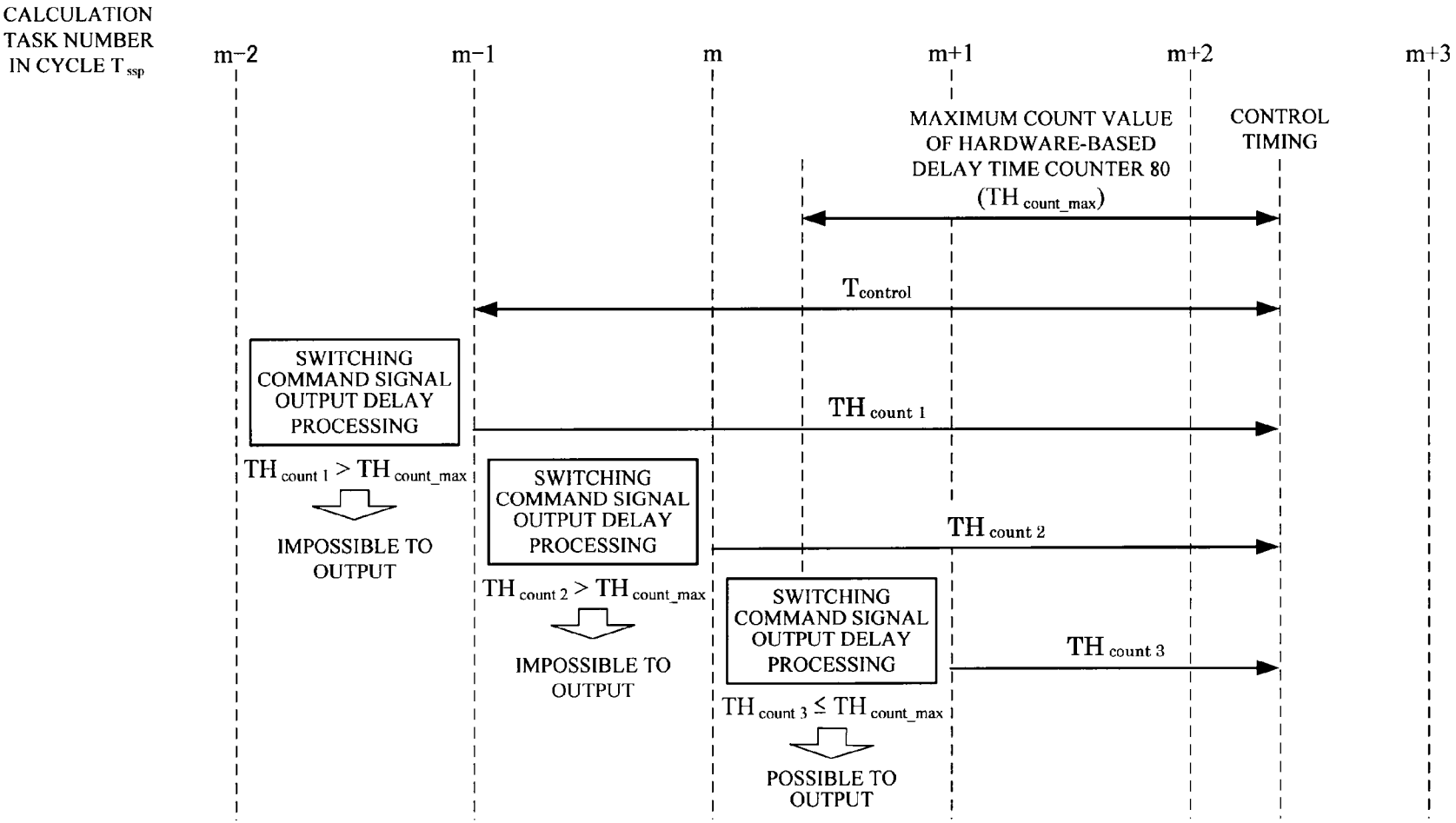
FIG. 10 is a diagram depicting a method for counting the switching control signal output time of a switching controlgear of circuit breaker according to Embodiment 4 of the present invention.

FIG. 10 is a diagram depicting the counting operation of the software counter by the switching command signal output delay means 20*a* and the counting operation by the hardware-based delay time counter 80.

<Software Counter by Switching Command Signal Output Delay Means 20*a*>

The switching command signal output delay means 20*a* compares the switching control signal output time $T_{control}$ calculated by the switching control signal output time calculation means 10*a* and the maximum count value $TH_{count_max}$ of the hardware-based delay time counter 80.

FIG. 10 shows an example of the starting counting operation in the calculation task (m−2) in the cycle $T_{ssp}$. The switching control signal output time $T_{control}$ at this time is the switching control signal output time with the timing of the next calculation task (m−1) as a reference point.

(4-i) Calculation Task (m−2)

The control time $TH_{count1}$ (delay time counter value) to be transferred to the delay time counter 80 is calculated.

$$TH_{count1}=T_{control}$$

In this case, $TH_{count1}>_{THcount_max}$, so the calculation task (m−2) does not transfer the control time $TH_{count1}$ to the delay time counter 80.

(4-ii) Calculation Task (m−1)

The control time $TH_{count2}$ (delay time counter value) to be transferred to the delay time counter 80 is calculated. Since the time $T_{ssp}$ has already elapsed at this time, $$TH_{count2}=T_{control}-T_{ssp}$$

In this case, $TH_{count2}>T_{count_max}$, so the calculation task (m−1) does not transfer the control time $TH_{count2}$ to the delay time counter 80.

(4-iii) Calculation Task (m)

The control time $TH_{count3}$ (delay time counter value) to be transferred to the delay time counter 80 is calculated. Since the time $(2\times T_{ssp})$ has already elapsed at this time $$TH_{count3}=T_{control}-2\times T_{ssp}$$

In this case, $TH_{count3}\leqq TH_{count_max}$, so the calculation task (m) transfers the control time $TH_{count3}$ to the delay time counter 80.

As described above, the switching command signal output delay means 20*a* performs subtraction processing in $T_{ssp}$ units for the switching control signal output time $T_{control}$ until the hardware-based delay time counter 80 can perform the counting operation. In other words, a rough counting operation by software counter is executed.

<Counting Operation by Hardware-Based Delay Time Counter 80>

The hardware-based delay time counter 80 counts the delay time for the count value $TH_{count3}$ received from the switching command signal output delay means 20*a*.

After the delay time of the delay time counter value $TH_{count3}$ received from the switching command signal output delay means 20*a* is elapsed, the delay time counter 80 outputs the trigger signal to the switching command output unit 30.

A semiconductor switch of the switching command output unit 30 to which the trigger signal was input is turned ON, and the synchronous opening control signal or synchronous closing control signal of the circuit breaker (circuit breaker drive current) flows through the circuit breaker driving coil 620 (trip coil TC or closing coil CC), the circuit breaker performs open operation or close operation. Needless to say, a similar effect can be implemented in the synchronous closing control.

(Advantageous Effect)

As described above, according to Embodiment 4, the current flow timing of the circuit breaker drive current which determines the final precision of the synchronous switching control is controlled by hardware counter which has high precision and high resolution, so higher precision synchronous switching control can be implemented.

The counter processing by software is only for rough counting processing, so the operation load on the MPU can be decreased.

Embodiment 5

A synchronous switching controlgear of a circuit breaker according to Embodiment 5 of the present invention will now be described.

(Configuration)

Figure 11:
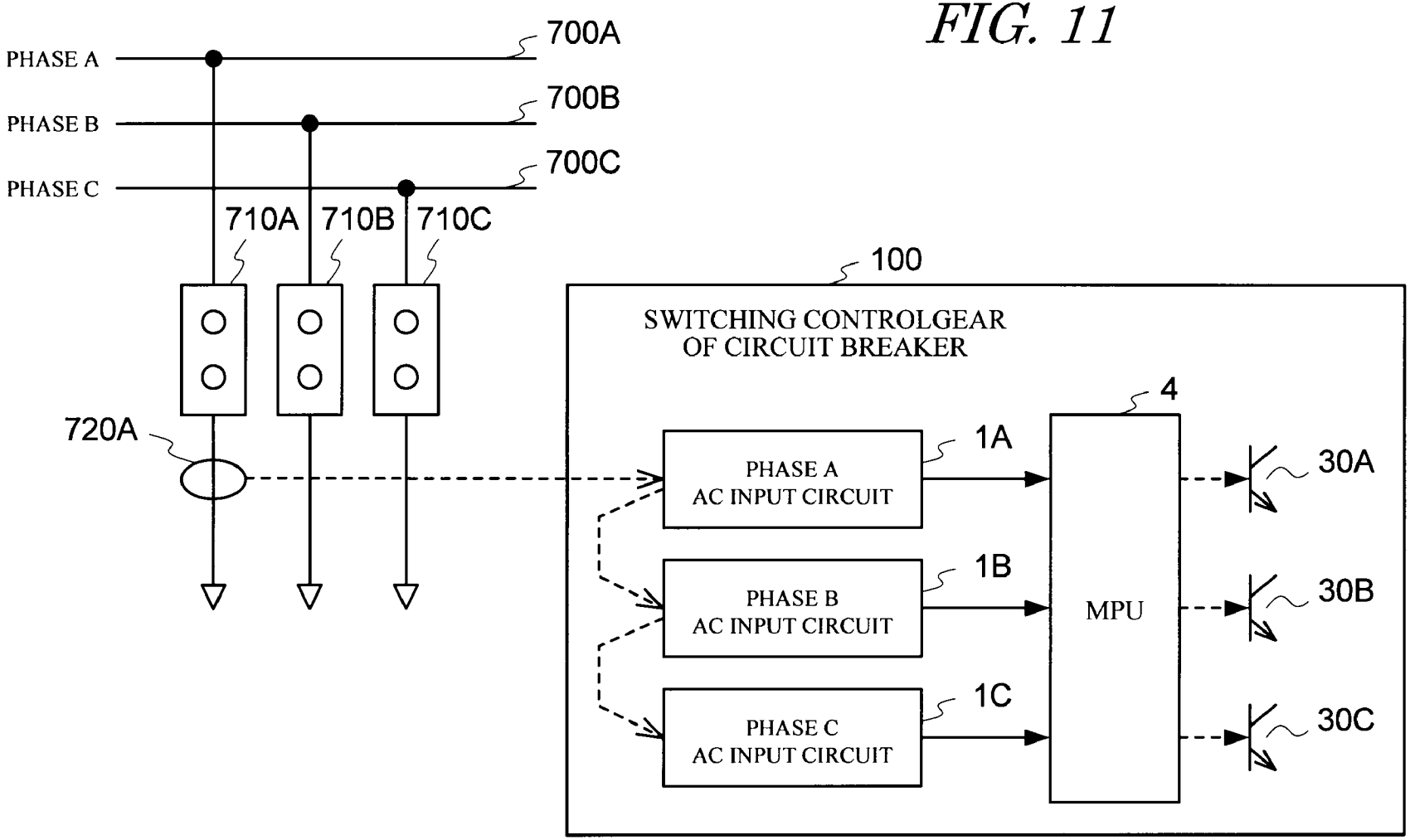
FIG. 11 is a diagram depicting a configuration of a synchronous switching control system of a circuit breaker according to Embodiment 5 of the present invention.
Figure 12:
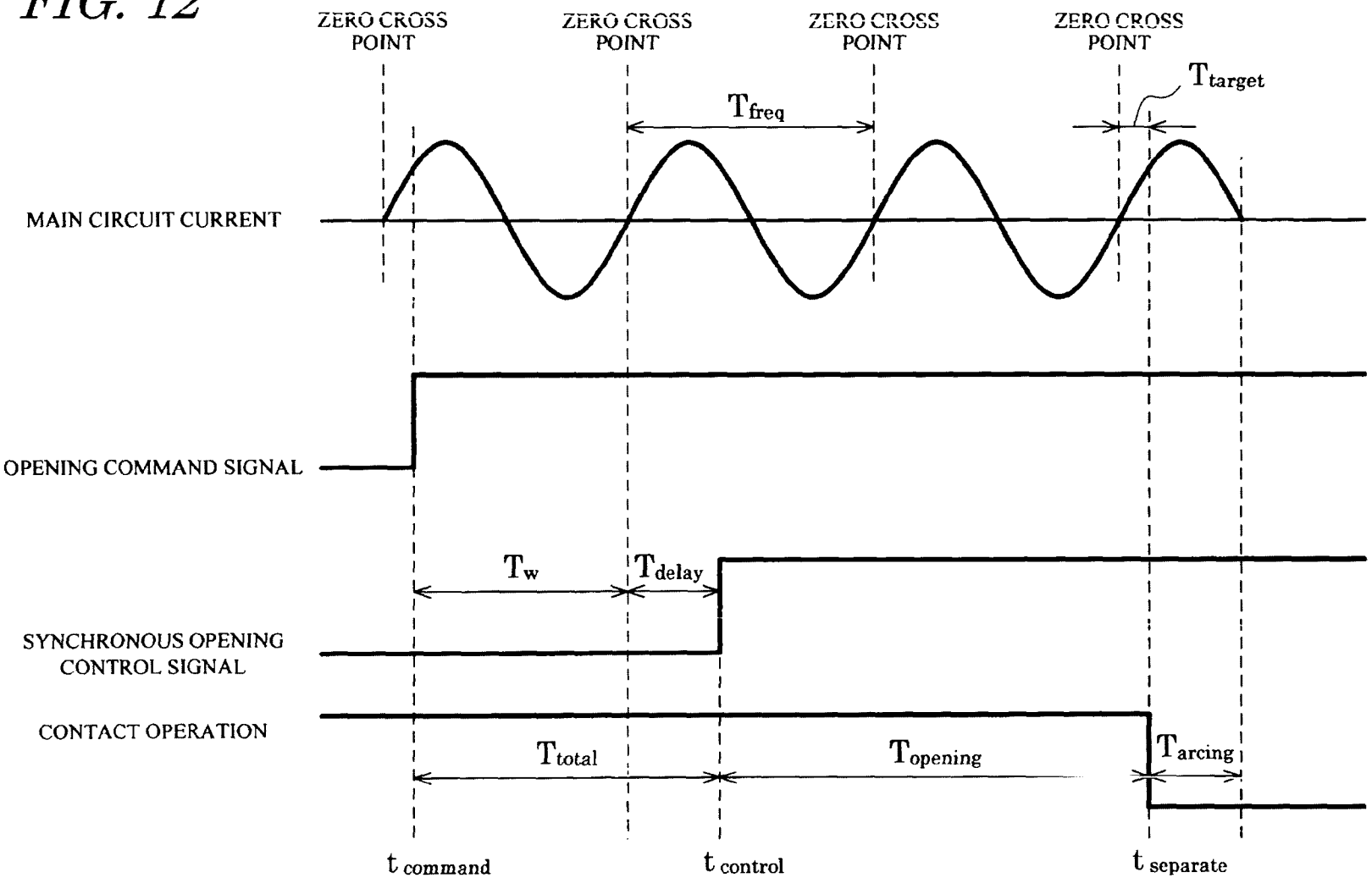
FIG. 12 PRIOR ART
FIG. 12 is a timing chart depicting synchronous opening control of a conventional switching controlgear of circuit breaker.

FIG. 11 is a diagram depicting a configuration of the synchronous switching control system of the circuit breaker according to Embodiment 5.

A difference of the system configuration of Embodiment 5 from the synchronous switching control system of the circuit breaker shown in FIG. 1 is that a current transformer is disposed only in one phase, as shown in FIG. 11. The illustration of a common portion with FIG. 1, which is unnecessary for describing Embodiment 5, is omitted.

In the case of Embodiment 5, a current transformer 720A which is installed only for phase A, and AC input circuits 1A, 1B and 1C of each phase in the switching controlgear of circuit breaker 100D, are connected in series. Information of the main circuit current signal in Phase A is input to the AC input circuit of each phase and MPU of each phase of the switching controlgear 100D respectively.

If an voltage transformer (PT or PD), which is a power system voltage measurement means, is installed only for one phase, the voltage transformer installed for only one phase and the AC input circuits 1A, 1B and 1C of each phase of the switching controlgear of circuit breaker 100D, are connected in parallel, although this is not shown in FIG. 11.

In the case when the secondary current output of the current transformer is converted into voltage by the current-voltage converter, and is then input to the switching controlgear of circuit breaker 100D, and the main circuit current information converted into voltage is for only one phase as well, the current-voltage converter installed for only one phase and the AC input circuits 1A, 1B and 1C for each phase of the circuit breaker switching control circuit 100D, are connected in parallel.

(Function)

In Embodiment 5, the current transformer is installed only for one phase, therefore information on the main circuit current signal is only for one phase (only for Phase A in the example in FIG. 11).

This means that it is necessary to calculate the switching control signal output time for three phases, $T_{control_A}$, $T_{control_B}$ and $T_{control_C}$, using the main circuit current signal only for one phase. The calculation method for the example in FIG. 11 will now be described as a variant form of Embodiment 2.

In Embodiment 5, the calculation method used by the synchronous delay time calculation means 50 of the calculation task in the cycle $T_{100ms}$ is different from Embodiment 2.

In the calculation of the synchronous opening delay time $T_{delay}$ [ms], calculation is performed for each phase using the independent main circuit current information of each phase in Embodiment 2, but in Embodiment 5, the synchronous opening delay time for three phases $T_{delay_A}$, $T_{delay_B}$ and $T_{delay_C}$ [ms] must be calculated using the main circuit current information only for one phase (phase A in the example in FIG. 11).

$$\text{Phase } A\text{: } T_{delay_A}=T_{target_A}-(T_{opening_A}\ \%\ T_{freq})\ [\text{ms}]$$

$$\text{Phase } B\text{: } T_{delay_B}=T_{target_B}-(T_{opening_B}\ \%\ T_{freq})+120/360\times T_{freq}\ [\text{ms}]$$

$$\text{Phase } C\text{: } T_{delay_C}=T_{target_C}-(T_{opening_C}\ \%\ T_{freq})+240/360\times T_{freq}\ [\text{ms}]$$

Here the phase sequence of the three phases is phase A→phase B→phase C.

If the calculation result is negative, correction is performed so that the result becomes a positive value, just like Embodiment 2.

The other processing is the same as Embodiment 2, except that such processing as the detection of a zero cross point, calculation of the reference point-command signal interval time $T_{zero}$, and calculation of the switching control signal output time $T_{control}$ are executed for each phase using the main circuit current information for phase A.

In the above description, the case of performing synchronous opening control using the main circuit current signal only for one phase was described, but needless to say, the same calculation method can be applied for the case of performing synchronous opening control or synchronous closing control using the power system voltage signal only for one phase.

In the description, a variant form of the Embodiment 2 was described, but a similar calculation method can be applied as a variant form of Embodiment 1.

(Advantageous Effect)

According to Embodiment 5, the synchronous opening control or synchronous closing control can be applied without adding a main circuit current detection means or a power system voltage detection means, even for a system in which a main circuit current detection means and power system voltage detection means, such as a current transformer and an voltage transformer, are installed only for one phase.

In particular, the method of the present invention is effective to execute the synchronous opening control or synchronous closing control for each single phase in a state as mentioned above.

The invention claimed is:

1. A switching controlgear of circuit breaker which causes a circuit breaker to open or to close at a desired phase of power system voltage or main circuit current, comprising:

estimated circuit breaker operation time calculation means for constantly and repeatedly calculating an estimated opening operation time or estimated closing operation time of the circuit breaker according to a state of the circuit breaker;

switching command signal output delay means for delaying an output timing of an opening command signal or closing command signal to the circuit breaker so as to cause the circuit breaker to open or to close at the desired phase when the opening command signal or closing command signal is detected;

switching control signal output time calculation means for calculating a switching control signal output time, which is a delay time from a timing of detecting the opening command signal or closing command signal to a timing of that the switching command signal output delay means outputs the opening command signal or closing command signal to the circuit breaker;

reference point detection means for periodically detecting a reference point of the power system voltage or main circuit current;

synchronization delay time calculation means for calculating synchronization delay time using the reference point detected by the reference point detection means as a reference; and reference point-command signal interval time calculation means for calculating a reference point-command signal interval time which is time from the reference point to a detection timing of the opening command signal or closing command signal, wherein:

the synchronization delay time calculation means calculates the synchronization delay time using the reference point as a reference so that the circuit breaker opens or closes at the desired phase after the total time of the synchronization delay time and estimated opening operation time or the estimated closing operation time of the circuit breaker calculated by the estimated circuit breaker operation time calculation means is elapsed, the switching control signal output time calculation means calculates the switching control signal output time based on the time length relationship of the reference point-command signal interval time and the synchronization delay time calculated by the synchronization delay time calculation means, and the switching command signal output delay means outputs a delay-controlled opening command signal or a delay-controlled closing command signal to the circuit breaker after the switching control signal output time, which is the latest, is elapsed when an opening command signal or closing command signal is actually detected.

2. The switching controlgear of circuit breaker according to claim 1, wherein the reference point is such that a next reference point is estimated based on at least the timing of the latest reference point.

3. The switching controlgear of circuit breaker according to claim 1, wherein the reference point is a zero cross point of the power system voltage or main circuit current.

4. The switching controlgear of circuit breaker according to claim 1, wherein, when a first phase of opening or closing is specified, or when a phase sequence of opening or closing is specified, or when both the first phase and the phase sequence of opening or closing are specified, the time length relationship of the switching control signal output time between phases is adjusted according to the specified first phase and phase sequence.

5. The switching controlgear of circuit breaker according to claim 1, wherein the switching command signal output delay means comprises a hardware counter and a software counter, and the delay control is executed by the software counter until the switching control signal output time becomes less than or equal to a maximum counter value of the hardware counter when the switching control signal output time is greater than the maximum counter value of the hardware counter.

6. The switching controlgear of circuit breaker according to claim 1, wherein, when the current detection means or voltage detection means is set only for one phase, the synchronization delay time calculation means calculates the synchronization delay time of a phase for which the current detection means or voltage detection means is not set, using as a reference the reference point of the phase for which the current detection means or voltage detection means is set.

* * * * *